US007648613B2

(12) United States Patent
Leimu

(10) Patent No.: US 7,648,613 B2
(45) Date of Patent: Jan. 19, 2010

(54) METHOD AND ARRANGEMENT IN A PAPER MACHINE OR THE LIKE CLOSE TO A MOVING WEB TO BE DRIED AND USUALLY SUPPORTED AGAINST A WIRE, SEALING DEVICE AND PAPER MACHINE

(75) Inventor: Juha Leimu, Turku (FI)

(73) Assignee: Metso Paper, Inc., Helsinki (FI)

( * ) Notice: Subject to any disclaimer, the term of this patent is extended or adjusted under 35 U.S.C. 154(b) by 336 days.

(21) Appl. No.: 11/578,687

(22) PCT Filed: Jun. 3, 2005

(86) PCT No.: PCT/FI2005/000257

§ 371 (c)(1),
(2), (4) Date: Oct. 16, 2006

(87) PCT Pub. No.: WO2005/118951

PCT Pub. Date: Dec. 15, 2005

(65) Prior Publication Data

US 2008/0060776 A1 Mar. 13, 2008

(30) Foreign Application Priority Data

Jun. 3, 2004 (FI) ..... 20040761

(51) Int. Cl.
*D21F 3/02* (2006.01)

(52) U.S. Cl. ..... 162/205; 162/263; 162/363; 34/425; 34/456; 34/120

(58) Field of Classification Search ..... 162/205, 162/263, 363; 34/425, 456, 457, 120, 114
See application file for complete search history.

(56) References Cited

U.S. PATENT DOCUMENTS

| | | | |
|---|---|---|---|
| 5,230,168 | A | 7/1993 | Heinzmann et al. |
| 5,341,579 | A | 8/1994 | Schiel et al. |
| 6,192,597 | B1 | 2/2001 | Kahl et al. |
| 6,247,247 | B1 | 6/2001 | Yömaa et al. |
| 6,848,195 | B2 | 2/2005 | Leimu |
| 2003/0034139 | A1 | 2/2003 | Kahl et al. |
| 2006/0070258 | A1 | 4/2006 | Leimu et al. |

FOREIGN PATENT DOCUMENTS

| | | |
|---|---|---|
| FI | 925656 | 12/1992 |
| FI | 102774 | 10/1998 |
| FI | 111280 | 5/2003 |
| WO | WO 03/040468 | 5/2003 |
| WO | WO 2004/046460 | 6/2004 |

(Continued)

*Primary Examiner*—Mark Halpern
(74) *Attorney, Agent, or Firm*—Cohen Pontani Lieberman & Pavane LLP

(57) ABSTRACT

The invention comprises a method and an arrangement in a paper machine or the like close to a moving web (29) usually supported against a wire (1), and a paper machine including such an arrangement, and a sealing device having several such arrangements (100). According to the invention, a movable sealing (5) is arranged in the drying section of a paper machine, between two regions (3, 4) with different pressures. Certain air amounts (V1, V2) are supplied to and/or discharged from each side of the sealing (5) in order to create certain pressures in said regions. Air can move between said regions only through certain paths. In normal operating situations the seal (5) according to the invention is automatically adjusted to the desired position in relation to the web.

8 Claims, 4 Drawing Sheets

METHOD AND ARRANGEMENT IN A PAPER MACHINE OR THE LIKE CLOSE TO A MOVING WEB TO BE DRIED AND USUALLY SUPPORTED AGAINST A WIRE, SEALING DEVICE AND PAPER MACHINE

PRIORITY CLAIM

This is a national stage of application No. PCT/FI2005/000257, filed on Jun. 3, 2005. Priority is claimed on Application No. 20040761, filed in Finland on Jun. 3, 2004.

TECHNICAL FIELD RELATED TO THE INVENTION

The invention relates to a method and an arrangement in a paper machine or the like close to a moving web to be dried and usually supported against a wire, to a sealing device, and to a paper machine, according to what is presented in the pre-ambles of the independent claims presented below. The invention relates particularly to a new manner to arrange sealings in the drying section of a paper machine.

In this text a paper machine or the like means particularly a paper machine or a board machine. A web means a paper web, which moves in the paper machine or a web of some other material, which is to be dried. A wire means an air permeable supporting surface, which in a paper machine or the like is used to support the web, the wire being for instance a net, a textile, a felt or a corresponding fabric.

PRIOR ART

In a paper machine, it is known to arrange regions of different pressures close to the moving web and wire in order to optimise their run. In order to maintain these pressure differences, different mechanical seals, among other things, have been used at the border between these regions of different pressures. The negative pressure regions and the seals are typically located on one side of the wire, and the web is located on the opposite side.

Mechanical seals will wear when they contact the moving wire. At the same time they can cause damage to the moving wire. Among other things, this makes it necessary to control the distance between a mechanical seal and the wire. It would be beneficiary to be able to change the distance between the seal and the wire during a run, for instance by remote control. It would be useful to have an accurate control of the distance, as the required changes of the pressure differences and air streams during the run are often very small and fast.

The seal is usually positioned against the wire, which in a normal running situation slightly moves toward the seal and away from it. Then a stationary or slowly moving seal can easily get in contact with the wire, which damages the wire and/or the seal. If the wire comes very close to the seal, then the wire and the web can be sucked fairly tightly against a suction box or the like having a negative pressure.

Different solutions have been proposed in order to provide a moving seal. However, there have been some difficulties in accurately controlling the distance between a mechanical seal and the wire. It is often difficult to obtain a seal, which can be accurately moved, but at the same time moved rapidly, when required. In addition, the seal should have a stable location so that it will not slide out of its position during use, against the will of the apparatus operator.

The published PCT application WO 2004/046460 presents a seal, where the distance between the seal and the wire is guided by controlling the pressure of the bellows-like space arranged behind the seal moving in relation to the wire. In some operation situations it is difficult to measure and control the pressures with the required accuracy, and this operation is also quite slow. Thus the adjustment of the seal's position will easily be inaccurate, unstable and slow.

The published PCT application WO 2003/040468 presents a blow box where the Coanda surfaces of the box are hinged in order to allow their movement.

In the prior art solutions the seal can be moved into a different position with the aid of external energy and based on external information, due to particular actions of the operative staff.

THE OBJECT OF THE INVENTION AND A SHORT DESCRIPTION

The object of the present invention is to reduce or even to eliminate the above mentioned problems occurring in prior art.

An object of the present invention is particularly to provide a new method in the drying section of a paper machine or the like for controlling the distance between the wire and the seals used close to the moving web and wire.

In order to realise, among other things, the above mentioned objects in a paper machine or the like, the method and arrangement according to the invention close to the moving web to be dried and usually supported against a wire, the sealing device, and the paper machine are characterised in what is presented in the characterising parts of the enclosed independent claims.

The embodiment examples and advantages mentioned in this text relate, when applicable, both to the method, the arrangement, the sealing device and the paper machine according to the invention, even if this is not always particularly mentioned.

According to a typical method and arrangement according to the invention in a paper machine or the like, at least two spaces at least mainly separated from each other are created close to the web to be dried and/or the wire typically supporting it, in which spaces different air pressures are typically maintained. Advantageously conduits known as well as possible are located between the spaces for transporting air in a controlled manner between the spaces. According to the invention, it is advantageous that the air streams supplied to these spaces and discharged from them are known and that they can be controlled as accurately as possible. Advantageously said spaces are thus relatively tight. The first and the second spaces are typically arranged close to the moving web or wire. At least one of these spaces at least partly borders on the moving web or wire. A seal is typically arranged between the first and second spaces, whereby the seal can move in relation to the web or the wire supporting it. Typically the distance of said seal from the web or the wire can be controlled. The second side of the seal is typically one of the walls of a possible third space. The pressures in said spaces and the air streams between these spaces are thus related to the distance of the seal from the web. According to the invention the seal's movement towards the web or away from the web is connected to the pressures in said spaces so that the pressure variations of said spaces directly move the seal. Thus in a normal operating situation no external control actions are required to move the seal according to the invention, but the pressures and air streams will automatically control the seal.

The invention can also be described as follows: A movable sealing element located between the first and the second spaces maintains the pressure difference prevailing over it as constant as possible, at the set point. The pressure difference created by the seal has an effect on means in the apparatus, for instance on the surfaces of the spaces, so that a feedback is created. This means that if the pressure difference deviates from the set point, then for instance the said means act on the seal with a correcting force depending on the magnitude of the deviation. The information about the set point can be input to the system for instance as the magnitude of a pressure or of an air stream. Said means and the manner in which the set point is determined are further explained below.

In the conditions referred to in the invention the measurement and control of the pressures has been traditionally difficult, inaccurate and time consuming. Now we have surprisingly found that the pressures present in the spaces can be controlled indirectly by measuring and controlling for instance the control air streams supplied to said spaces and discharged from them, and by arranging the sealing solution to be self-adjusting. When said control air streams in a solution according to the invention have been adjusted to be constant, then the pressures in the spaces and the distance of the seal from the web will find a state of equilibrium. By controlling the control air streams this state of equilibrium can thus be set as desired. The measurement and control of the volume air streams is accurate and rapid with the aid of conventional control and measurement devices for air streams. Also with current devices it is easy to have an almost continuous control of the air streams. According to the invention, when the control air streams have once been adjusted to the desired values, then in the normal operating situation the seal moves in relation to the web due to the pressures prevailing in said spaces and gaps and due to the effect of the air streams, without any particular control actions. A normal operating situation includes slight changes in the conditions, such as web flutter, wire swing or small variations in the control air streams, which will be automatically corrected as the seal can rapidly move due to the effect of the pressures and air streams. The invention provides a position control of the seal, which is more accurate and rapid than previously.

The invention is suitably used in a paper machine at least during threading, web spreading and during production with a normal full-width paper web.

A method according to the invention in a paper machine or the like close to a moving web to be dried and typically a wire arranged to support it comprises the following steps:

In connection with the web to be dried and/or the wire, two spaces with different pressures are maintained one after the other in the web's direction of travel, whereby these spaces in this text are called the first space and the second space. Depending on the situation, either a space with a higher pressure or a space with a lower pressure can be located first in the web's direction of travel. In the cross direction of the paper machine, such spaces usually cover the whole width of the machine. In the cross direction, the space can also be divided into several shorter sections. If the space can be arranged to have a positive or negative pressure compared to the ambient pressure, then a space is typically defined by substantially tight walls on all sides except on that side which is against the web and/or wire. The space can also be a part of the paper machine, which is not defined by walls. The fact that the first and second spaces are located in connection with the web to be dried means that at least one of these spaces is defined in at least one direction by the web to be dried or by the wire supporting the web.

A first control air stream is sucked out from the second space in order to generate a negative pressure in the second space. Then a conduit to the second space is required to transport the air stream. For instance, at the opening nip in a paper machine's drying section it is known to maintain after the opening nip a negative pressure at least on one side of the web in order to keep the web against the wire in a controlled way.

The volume flow of the first control air stream is monitored and controlled. Suitable sensors are required to measure the volume flow discharged from the second space. In order to control the volume flow, it is for instance possible to adjust the effect of the blowers removing air from the apparatus. However, the arrangement is typically connected to control automatics, which keeps the desired distance between the seal and the web or wire, when required.

Between the first and second spaces there is kept a seal in order to maintain the said pressure difference with the seal's first side toward the web and its second side toward a third space. A seal is required, because due to the pressure difference between the spaces and due to the effect of the moving web and wire, the air tends to travel between the first and second spaces. The possible third space is typically a space mainly separated from the first and second spaces, whereby the second side of the seal typically defines the third space in one direction. In the other directions, typically substantially tight walls define the third space. A typical seal according to the invention comprises a sealing seal member intended to be located toward the web or the wire, and a frame part, to which the seal member is fastened. Then the other side of this frame part is typically toward the third space.

Air is transported between the first and second spaces through a first gap between the seal and the web. A mechanical seal is typically not mounted completely tight against the moving wire or web, because one wants to avoid damage of the moving wire or web and wear of the seal.

A second control air stream is supplied to the third space. Then a conduit to the third space is required to supply the air stream.

The volume flow of the second control air stream is monitored and controlled. Suitable sensors are required to measure the volume flow supplied to the third space. In order to control the volume flow it is for instance possible to adjust a valve or a damper located in the conduit, or it is possible to control the effect of the blowers blowing air into the apparatus.

The seal is moved toward the web or wire or toward the third space in order to control the size of a first gap. The seal is then arranged to be movable in relation to the moving web or wire with the aid of some suitable means. The seal can be for instance hinged at the upper or lower edge of its frame part to the wall of the third space. Thus, the third space is for instance a chamber in the cross direction of the machine being defined in one direction by the second side of the seal's frame part, whereby the volume of the chamber is varied by moving the seal. The maximum length of the seal's path is typically arranged to be for instance about 10 mm, 20 mm, 30 mm, 40 mm or 50 mm.

Air is transported between the second and third spaces through a second gap formed between them.

In a normal operating situation, the seal moves without any particular control actions toward the web or wire, or toward the third space due to the effect of the pressures and air streams prevailing in said spaces and gaps. Thus the seal will readily react on the pressure variations between the first and third spaces. The seal can move very rapidly to re-establish the desired pressure differences.

The invention makes it possible to retain a substantially constant pressure difference between the first and second spaces, even if any disturbances would occur in the process.

The arrangement according to the invention presented above operates in the following way: Assume that the first and second control air streams have been adjusted to be constant, so that a state of equilibrium has been achieved, whereby the second space has reached a suitable negative pressure compared to the first space and the seal is at a suitable distance from the web. The pressure of the first space can be assumed to be for instance the normal air pressure prevailing in the machine room of the paper mill. If now the web or the wire supporting it begins to move toward the seal, then the first gap is reduced and the air volume streaming through the first gap is reduced. Then the pressure in the second space is reduced, because a first control air stream with a substantially constant volume is continuously sucked out from the second space. This causes an increasing pressure difference between the second and third spaces, whereby more air begins to stream from the third space through the second gap into the second space. Then the pressure in the third space is reduced, because a second control air stream with a substantially constant volume is continuously supplied to the third space. As the pressure difference between the normal air pressure in the first space and the third space changes, the seal then moves toward the third space, i.e. away from the web and/or the wire. Then the first gap grows and more air begins to stream from the first space into the second space. Then the pressure in the second space increases and the state of equilibrium is re-established.

If the web initially moves away from the seal, then the arrangement according to the invention operates in a corresponding manner and re-establishes the state of equilibrium by reverse actions compared to those described above.

A resistive member can be connected to the seal, such as a spring, which can adjust the resistance of the seal's motion in different positions of its path. The seal can also be shaped so, or mounted in a certain position, for instance hinged, so that forces of different magnitudes are required to move the seal at different positions of its path.

Thus, the first and second control air streams will regulate the desired pressure difference between the first and second spaces as well as the desired distance between the seal and the wire or web. In one embodiment of the invention, the first control air stream and/or the second control air stream are kept mainly constant in a normal operating situation. When necessary, the control air streams can of course be adjusted also during a normal operating situation, for instance when it is desired to increase the negative pressure of the second space, or to move the seal closer to the wire or web. In practice it is so that changing the first control air stream has an influence mainly on the seal's distance from the wire or web in the state of equilibrium. Changing the second control air stream mainly affects the negative pressure in the second space compared to the first space in the state of equilibrium.

The arrangement according to the invention described above is very rapid. The automatic control actions are typically performed in fractions of a second. Even a rapid movement of the seal will not cause any substantial vibrations in the apparatus to which it is fastened, as the moving seal can be arranged to be very light and easily movable in the arrangement according to the invention.

In a normal operating situation there will be less contact between the moving wire and web and the seal due to the invention. A seal according to the invention tends the whole time to be at a constant distance from the wire and web. Thus, there is less wear of the seal, and damage of the wire or web will be reduced.

With the aid of the invention, the seal can be kept close to the wire and web, whereby the solution is economical. As the first gap is small, there flows very little discharged air to the second space. The volume of supplied air, i.e. the second control air stream, is also quite small. Thus, small air volumes are sufficient in an arrangement according to the invention. Then for instance the blowers used to discharge the air require only a low effect.

In a normal operating situation the invention operates automatically and fully mechanically, even without any electric control devices. The feedback control takes place locally via air streams, pressures and the seal's motion. No information needs to be used outside the arrangement according to the invention. In a sense, the control air streams according to the invention can transport all the data required for the control from the user to the seal and in the opposite direction. There is no need to transform the data required by the control from one energy form to another at the seal or in its vicinity.

With the aid of the invention, the second space can reach greater negative pressures than previously, as the risk of the wire or web to be sucked against the seal or the suction box where the second space with the negative pressure has been arranged is lower than in prior art solutions.

For an accurate operation of the invention, it is usually advantageous that the supplied second control air stream is kept as constant as possible. In one embodiment of the invention, the second control air stream is thus taken from a compressed air network, advantageously through a strongly acting throttle, whereby a reasonably constant air stream can be obtained.

If the invention comprises several shorter arrangements according to the invention located side by side in the machine's cross direction, it is easy to accurately adjust the negative pressure level and sealing also in the machine's cross direction. This is advantageous particularly in wide paper machines, because the wire tends to bend in the machine's cross direction. One such arrangement could then have a length of for instance about one metre in the machine's cross direction.

For the first control air stream it is possible to realise a sufficiently even volume flow for instance in the following manner. A stronger negative pressure is kept in the suction system than in the second space according to the invention, and the air stream from the second space is guided through a throttle to the suction system. Then the throttle's share of the total pressure difference determines the magnitude of the variation in the air stream during a regulating situation. The variation of the volume flow in the first control air stream mainly acts only on the distance between the seal and the wire, but not on the magnitude of the negative pressure formed in the second space. A small variation of the distance between the seal and the wire will not usually have any practical influence on the operation of the apparatus.

When both the first and second control air streams are measured and controlled, it is possible to accurately and rapidly adjust both the distance of the seal from the moving wire or web and the pressure difference between the first and second spaces.

In an embodiment of the invention, the seal comprises a movable edge, which moves at a distance from one wall of the third space as the seal moves in relation to the third space, so that a second gap is formed between said edge and the wall of the third space. Then air can pass through this gap from the third space to the second space. When the second gap is formed between the moving seal and the stationary wall of the third space, there is no need to make any separate opening in the wall of the third space for the gap.

In an embodiment of the invention, the seal is hinged at its upper edge, whereby its lower edge moves at a distance from the wall of the third space when the seal moves, so that a second gap is formed between the lower edge of the seal and the wall of said third space. As the seal is hinged at its upper edge, it can be easily arranged so that its movement is easily controlled. It can be easily arranged to have a stable position, so that in the case of a possible operating disturbance, for instance if all control air pressures are stopped, then the seal turns around its hinge, away from the web or wire.

In an embodiment of the invention, the seal is arranged so that in a normal operating situation the distance of the seal's lower edge from the wall of the third space remains substantially constant. In other words, the size of the second gap remains substantially the same. Then it is easy to control the apparatus, as the air volume flowing from the second gap is very predictable.

In an embodiment of the invention, the seal is hinged in relation to the third space, so that the seal can turn and so that its distance from the wire, or the size of the first gap, will change as a function of the turning angle when the seal turns around its hinge. This simplifies and facilitates the controllability of the seal.

With the aid of an embodiment of this invention, the negative pressure in the negative pressure regions arranged close to the paper machine's moving web and wire can be created without using the prior art ejector principle. Then an arrangement according to the invention does not require air blows to be discharged through the gap between the web or wire and the seal, from the space where the negative pressure has to be created. When the machine is running the arrangement according to the invention acts as a rapid constant pressure regulator for the negative pressure regions. In a normal operating situation, the seal does not necessarily have any stationary position, but the seal can be arranged to be constantly moving. The arrangement according to the invention can be considered as a regulator, which controls the negative pressure to be maintained and the position of the seal in relation to the wire or web. The regulator is supplied with the set point value for the negative pressure to be maintained and the set point value for the seal's position in the form of separate control air streams. The magnitude of the control air stream can be considered to be the set point. The task of the control air streams is to regulate the seal's position in real time, so that the pressure remains at its set point. The control air stream also supplies the operating energy for the control function.

The invention provides a continuous, automatic and rapid control function including feedback.

SHORT DESCRIPTION OF THE FIGURES

The invention is described below in more detail with reference to the enclosed schematic drawing, in which FIG. 1 shows one arrangement according to the invention;

DETAILED DESCRIPTION OF THE EXAMPLES IN THE FIGURES

Figure 1:
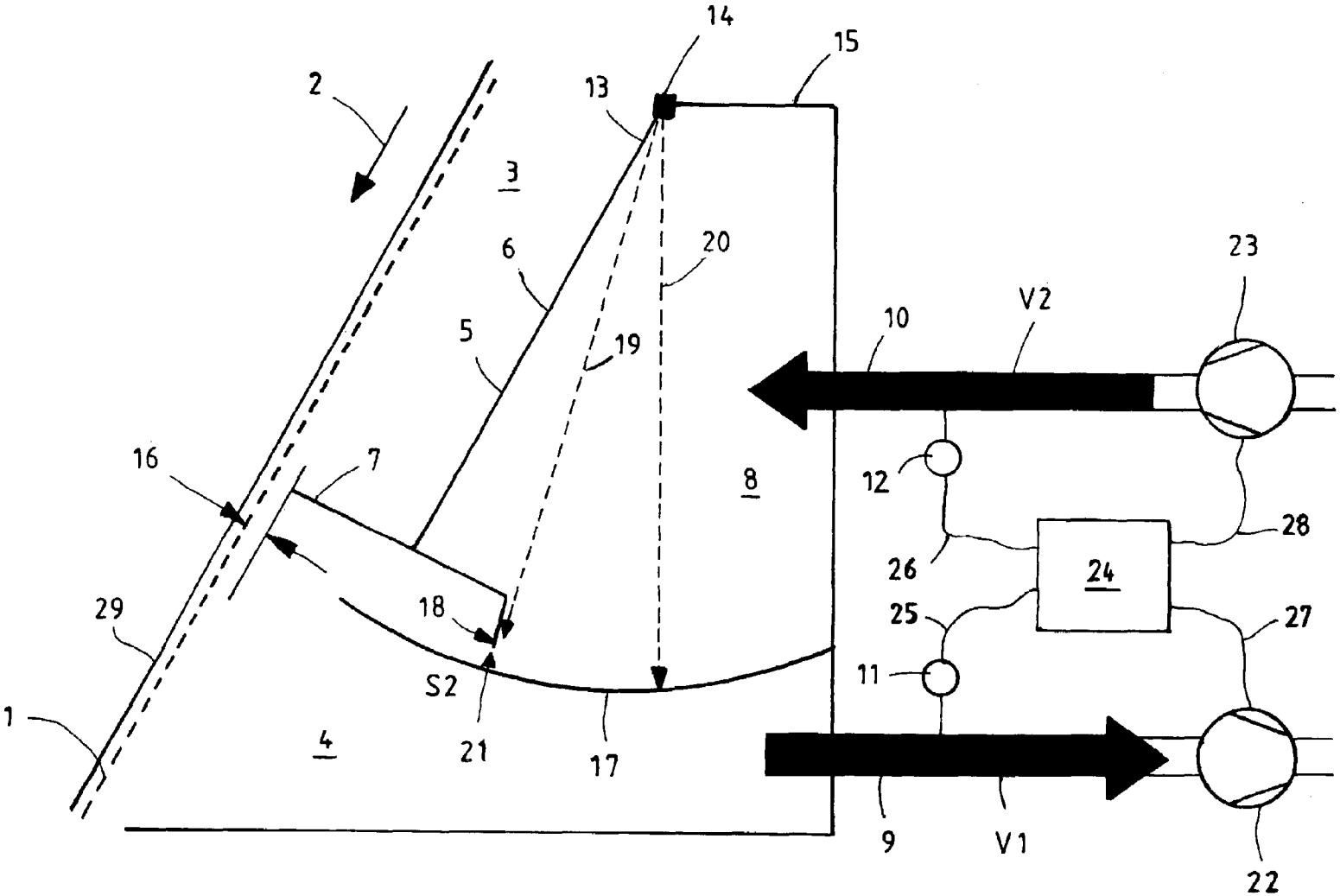

FIG. 1 shows the principle of one embodiment according to the invention. The paper web 29 to be dried and the wire 1 supporting it move in the direction shown by the arrow 2. In order to control the motion of the moving paper web 29 and the wire 1, there have been arranged on the right-hand side of the web in the figure, first a first space 3 with a normal air pressure and communicating with the machine room of the paper mill, and then after it, in the web's direction of travel, a second space 4 with a negative pressure. Between these there is a seal 5, which comprises a frame part 6 and a sealing part 7 intended to be close to the web. The sealing part 7 can be a prior art sealing solution suitable for this purpose, for instance a labyrinth seal. On the opposite side of the seal 5, as seen from the wire 1, there is a third space 8 with a positive pressure compared to the pressures of the first and second spaces. A blower 22 sucks air from the second space through a conduit 9. A blower 23 supplies air to the third space through a conduit 10. Both conduits 9 and 10 are equipped with sensors 11 and 12 in order to measure the volume flows V1 and V2 flowing in the conduits.

The upper part 13 of the seal's 5 frame part is hinged by a swinging hinge 14 to the upper wall 15 of the third space. When the seal turns around the hinge 14 the size of the gap 16 between the wire 1 and the sealing part 7 varies as a function of the seal's turning angle. The size of this first gap 16 determines the air volume passing between the first space 3 and the second space 4, and thus the pressure difference prevailing between them. The lower wall 17 of the third space mainly separates the third space 8 and the second space 4 from each other. An edge 18 is formed in that part of the lower edge of the seal 5, which is toward the third space. The seal 5 and the wall 17 are shaped so that in a normal operating situation the gap between the edge 18 and the wall 17 retains a constant size, regardless of the distance between the seal 5 and the wire 1. The arrow 19 represents the distance of the edge 18 from the hinge 14, and the arrow 20 represents the distance of the wall 17 from the hinge 14. The size of the second gap 21 formed between the edge 18 and the wall 17 equals the difference between the lengths of the arrows 20 and 19. Air can flow through the second gap 21 from the third space 8 to the second space 4. Mechanical limiters (not shown) can limit the motion of the seal 5. The maximum motion path of the seal can be for instance 10, 20, 30, 40 or 50 mm.

Assume that the pressure loss S1 caused by the first gap 16 and the pressure loss S2 caused by the second gap 21 are constant. Assume further that the volume flows V1 and V2 are constant. Then it is easy to show by simple deduction that the seal 5 will find a stable state of equilibrium at a certain distance from the web, whereby this distance is greater than zero, and whereby this distance depends on the volume flows V1 and V2 and on the resistance terms S1 and S2. The pressures prevailing in the different spaces in connection with the state of equilibrium can be calculated when the resistance terms S1 and S2 are known. Thus, a structure like that described above can control, in a relatively continuous and accurate manner, both the size of the first gap 16 and the pressure in the space 4 with the negative pressure, only by regulating the control air streams V1 and V2.

Figure 2:
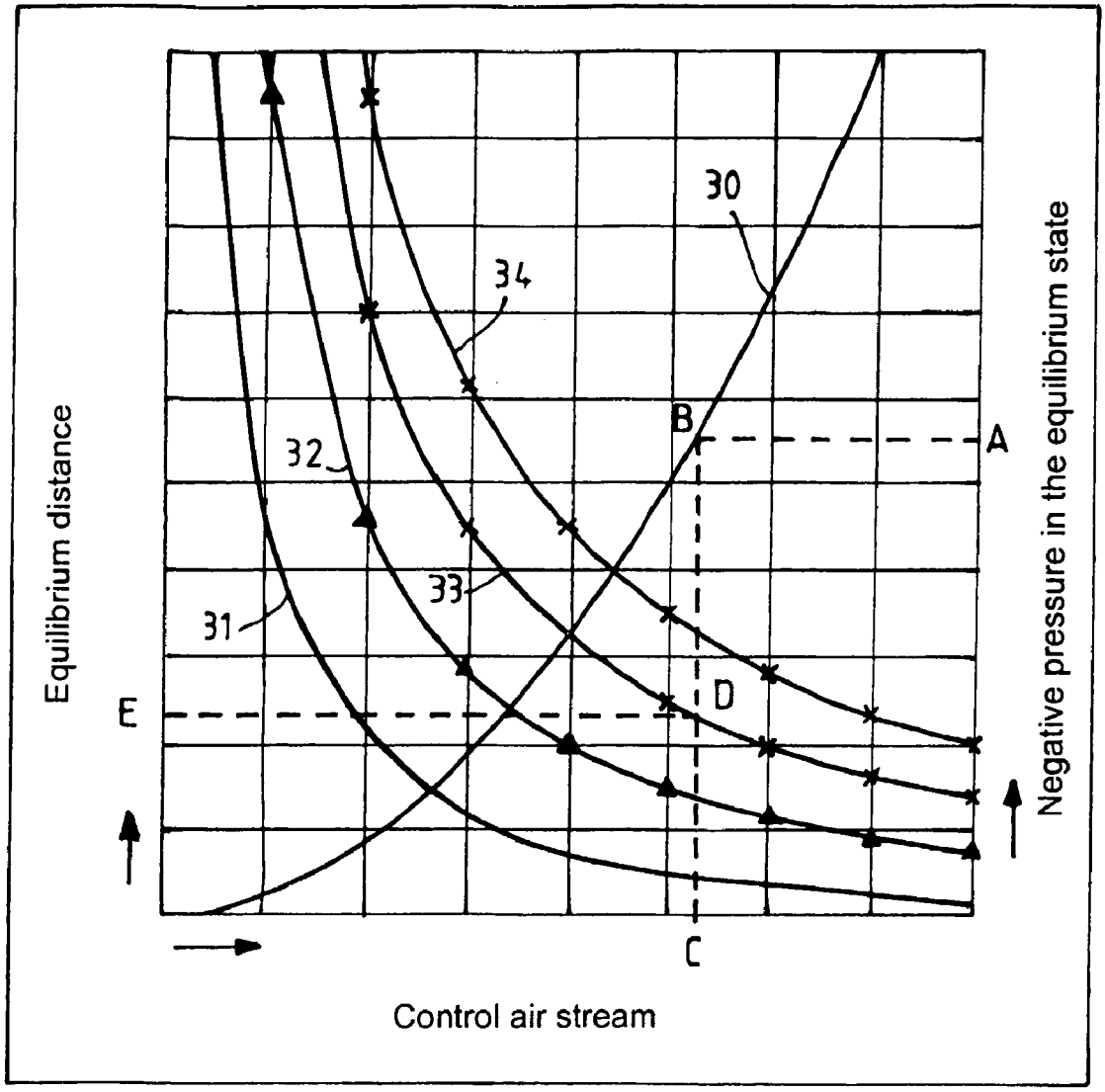
FIG. 2 shows graphically the pressure differences and the seal's distances from the web, which can be obtained with the arrangement according to the invention.

FIG. 2 shows some calculations for a structure according to FIG. 1. An example of an interpretation of FIG. 2 described below is marked with broken lines in FIG. 2. The figure is read as follows: The arrows represent the increasing direction of the quantities. The desired negative equilibrium pressure A is selected on the vertical axis on the right side, i.e. the desired negative pressure in the second space 4 in relation to the pressure in the first space 3. The only rising curve 30 in the figure represents this negative pressure. Corresponding to the intersection point B of the curve 30 and the desired negative equilibrium pressure we read the required second control air stream V2 on the horizontal axis, i.e. the value C of the volume flow of air supplied to the third space 8. The falling curves 31 to 34 represent some values of the first control air stream V1. Corresponding to the intersection point D between the point C just selected on the horizontal axis and the desired first control air stream, in our example the curve 33, we can read on the vertical axis on the left side the obtained equilibrium distance E for the gap 1 between the wire and the seal.

The calculations above are relatively easy to make for each solution. The resistance terms S1 and S2 can be estimated relatively accurately, and the estimations can be easily improved on the basis of measurement results. The results are easily programmed into required control logics. FIG. 1 shows schematically a control unit 24, which receives the signals 25 and 26 generated by the sensors 11 and 12. The control unit 24 generates the control signals 27 and 28 for the blowers 22 and 23, which create the control air streams V1 and V2. To a person skilled in the art it is obvious how the signals 25 and 26 representing the volume flows shall be connected to the control unit, and on the other hand, how the control unit should be connected for instance to the blower 23 generating the control air stream V2 and to the blower 22 generating the suction stream V1.

The adjustment of the control air streams presented above is usually performed only occasionally, for instance when the paper quality is changed, or when some other running parameters of the paper machine are changed. When the set points of the negative pressure and the seal's position are once adjusted to the required value, then there is no need to adjust them in a normal operating situation. The arrangement according to the invention is self-adjusting.

Figure 3:
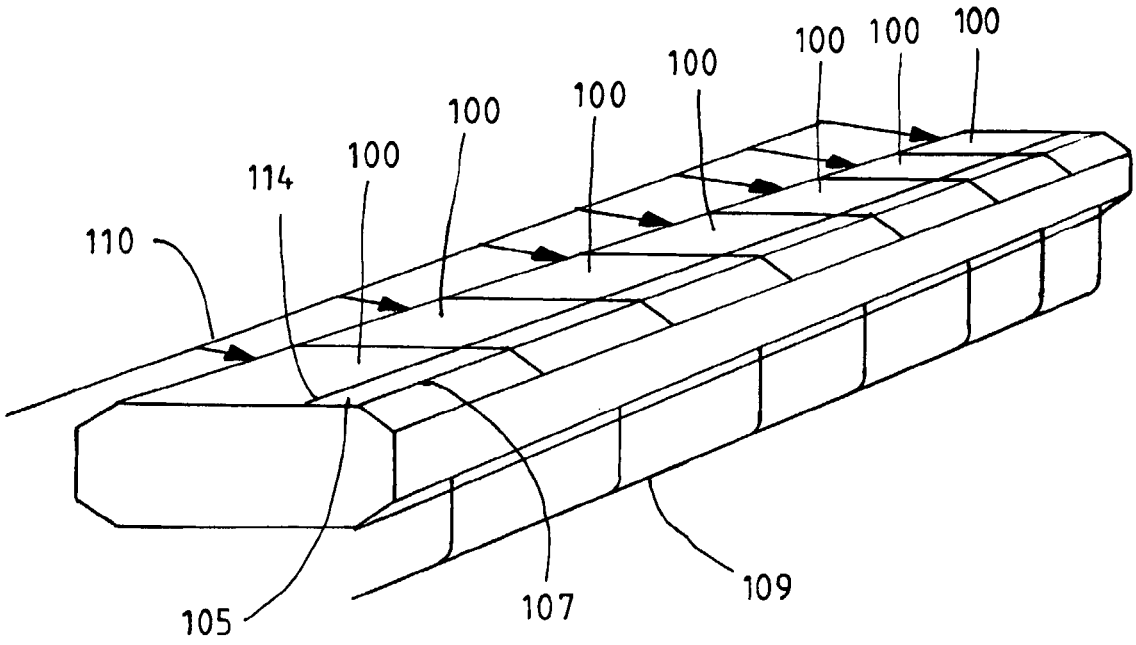
FIG. 3 shows a sealing device according to the invention.

FIG. 3 shows an application according to the invention where seven arrangements 100 according to the invention are placed in parallel to form a transversal sealing device for a paper machine. The sealing device can comprise the required number of parallel arrangements according to the invention, for instance 2, 3, 4, 5, 6, 7, 8, 9, 10, 11, 12, 13, 14, 15, 16, 17, 18, 19 or 20 arrangements. The width of a single arrangement can be selected to be suitable for each application. Each arrangement has its own seal 105, which moves independently and which with the aid of a hinge 114 is articulated to the frame of the sealing device. The edge 107 of the seal is arranged to move up and down in the figure. The figure does not show any moving wire or web, but in the figure they move above the device, horizontally from the left to the right. A first control air stream 109 is sucked separately from each single arrangement 100. Each single arrangement 100 is supplied with its own second control air stream 110. The control air streams 109 and 110 are shown schematically, and the figure does not show in more detail those conduits, through which the air streams are supplied to the separate arrangements 100. The arrangements 100 can for instance have a structure like that shown in FIG. 1. The set point of the supplied stream 110 and the discharged stream 109 of each single arrangement can be set independently of the other arrangements. Adjustment means required for this, such as required valves, are not shown in the figure. Thus, the seal 105 of each arrangement 100 can be set to a different position compared to the other seals. In the same manner, the pressure difference maintained over the edge 107 of each seal can be set to a desired value, independently of the other seals. The sealing device shown in FIG. 3 can easily and accurately adjust the negative pressure level and the sealing effect also in the machine's cross direction. This is advantageous particularly in wide paper machines, as the wire tends to bend in the machine's cross direction.

Figure 4:
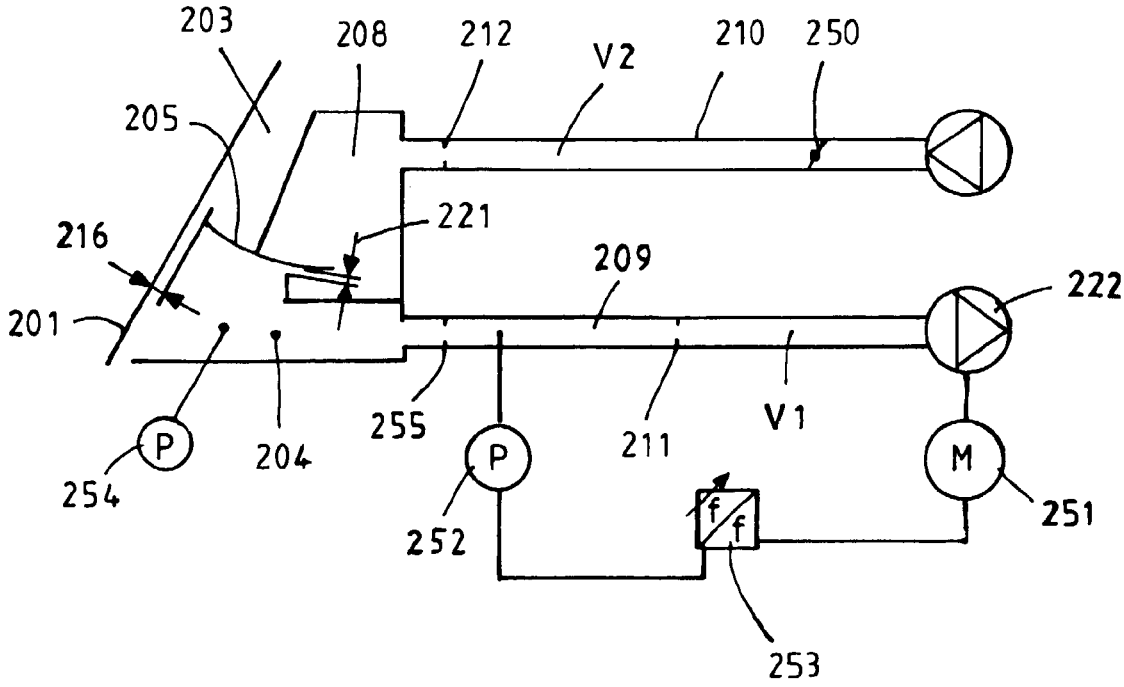
FIG. 4 shows schematically one arrangement according to the invention.

FIG. 4 shows schematically one possible application of the invention, which resembles the application shown in FIG. 1. A sensor 212 measures the volume flow supplied as the second control air stream V2 to the third space 208. A damper 250 in the conduit 210 is adjusted in order to control the volume flow V2. A sensor 211 measures the volume flow of the first control air stream V1. The effect of the electric motor 251 of the blower 222 discharging air from the apparatus is regulated in order to control the volume flow V1. A pressure sensor 252 located in the discharge conduit 209 generates a signal, which is connected to a frequency converter 253, which in turn controls the effect of the motor 251, if there are substantial pressure variations. A sufficiently even volume flow V1 of the first control air stream is realised so that a stronger negative pressure is kept in the discharge conduit 209 than in the second space 204. The pressure sensor 254 measures the negative pressure of the second space. The air stream V1 from the second space 204 is directed to a suction system through a throttle 255. In this way, the throttling's share of the total pressure difference determines the variation magnitude of the air stream V1 during a regulating situation. The volume flow variation of the first control air stream V1 mainly acts only on the distance 216 between the seal 205 and the wire 201, but not on the magnitude of the negative pressure created in the second space 204. A small variation in the distance between the seal and the wire does not usually have any practical effect on the operation of the apparatus. In the example of the figure, there is a constant distance 221 between the seal 205 and the wall of the third space 208, whereby air can pass from the third space 208 to the second space 204 through this gap. By measuring and controlling the first V1 and second V2 control air streams it is possible to both accurately and rapidly adjust the default values both for the distance between the seal 205 and the moving wire 201 or web and the pressure difference between the first 203 and second 204 spaces.

The figures show only advantageous embodiment examples according to the invention. The figures do not specifically show facts that are secondary regarding the main idea of the invention, facts known as such, or facts, which as such are obvious to a person skilled in the art, such as power sources or any supporting structures possibly required by the invention, or other parts of a paper machine. To a person skilled in the art it is obvious that the invention is not limited to the examples presented above, but that the invention may vary within the scope of the claims presented below. For instance, the means for moving a seal can be realised in many different ways. The manner, in which the set points are set with the aid of control air streams supplied to and discharged from the arrangement, is only one example of how the self-adjusting sealing arrangement according to the invention can be realised. The dependent claims present some possible embodiments of the invention, and as such they should not be considered to limit the scope of the invention.

What is claimed is:

1. A method in paper machine or a board machine close to a moving web to be dried and supported against a wire, the method comprising:

maintaining first and second spaces with different pressures in connection with the moving web to be dried or with the wire, the two spaces being located one after the other in a web travel direction of the moving web;

drawing a first control air stream (V1) out from the second space to create a negative pressure in the second space;

maintaining a seal between the first and second spaces to maintain a pressure difference between the first and second spaces;

transferring air between the first and second spaces through a first gap between the seal and the moving web or between the seal and the wire;

maintaining a third space having a pressure, which differs from the pressure in the second space, whereby the seal has a first side toward the web and a second side toward the third space;

supplying a second control air stream (V2) to the third space;

transferring air between the second space and the third space through a second gap created between the second and third spaces;

moving the seal toward or away from the moving web to control a size of the first gap based on an effect of at least one of pressures and air streams prevailing in at least one of the spaces and the gaps;

monitoring and controlling a volume flow of the first control air stream (V1); and monitoring and controlling a volume flow of the second control air stream (V2).

2. The method according to claim 1, further comprising moving the seal toward the moving web or toward the third space based on an effect of at least one of pressures and air streams prevailing in at least one of the spaces and gaps, without control actions.

3. The method according to claim 1, further comprising maintaining at least one of the first control air stream (V1) and the second control air stream (V2) substantially constant.

4. The method according to claim 1, wherein the third space is a chamber defined in one direction by the second side of the seal, whereby a volume of the chamber is variable by moving the seal.

5. The method according to claim 1, wherein the seal comprises an edge, and said step of moving the seal comprises moving the edge at a distance from a wall of the third space as the seal moves in relation to the third space, so that the second gap is formed between the edge and the wall of the third space.

6. The method according to claim 5, wherein said step of moving the seal comprises moving the seal so that the second gap remains substantially the same.

7. The method according to claim 1, wherein the seal is hinged at an upper edge, and said step of moving the seal comprises moving a lower edge of the seal at a distance from the wall of the third space as the seal is moved, so that the second gap is formed between the lower edge of the seal and the wall of the third space.

8. The method according to claim 1, wherein the seal is hinged to turn in relation to the third space so that a size of the first gap changes as a function of a turning angle when the seal is turned around a hinge.

* * * * *